US007357843B2

(12) United States Patent
Yamaguchi et al.

(10) Patent No.: US 7,357,843 B2
(45) Date of Patent: Apr. 15, 2008

(54) VACUUM HEAT TREATING METHOD AND APPARATUS THEREFOR

(75) Inventors: Kazuyoshi Yamaguchi, Tenri (JP); Yasunori Tanaka, Tenri (JP)

(73) Assignee: Koyo Thermo Systems Co., Ltd., Tenri-Shi ( * ) Notice: Subject to any disclaimer, the term of this patent is extended or adjusted under 35 U.S.C. 154(b) by 546 days.

(21) Appl. No.: 10/485,826

(22) PCT Filed: Nov. 30, 2001

(86) PCT No.: PCT/JP01/10467

§ 371 (c)(1),
(2), (4) Date: Feb. 18, 2004

(87) PCT Pub. No.: WO03/048405

PCT Pub. Date: Jun. 12, 2003

(65) Prior Publication Data

US 2004/0187966 A1 Sep. 30, 2004

(51) Int. Cl.
*C23C 8/20* (2006.01)
*C21D 1/74* (2006.01)

(52) U.S. Cl. ..... 148/223; 266/250

(58) Field of Classification Search ..... 148/223; 266/250, 252

See application file for complete search history.

(56) References Cited

U.S. PATENT DOCUMENTS 5,205,873 A * 4/1993 Faure et al. ..... 148/223
5,366,205 A * 11/1994 Gantois ..... 266/79
5,868,871 A * 2/1999 Yokose et al. ..... 266/252

FOREIGN PATENT DOCUMENTS

| | | |
|---|---|---|
| JP | 11-315363 | 11/1999 |
| JP | 2000-336469 | 12/2000 |
| JP | 2001-081543 | 3/2001 |
| JP | 2001-81543 | 3/2001 |
| JP | 2001-240954 | 9/2001 |
| JP | 2001-262313 | 9/2001 |

* cited by examiner

*Primary Examiner*—Scott Kastler
(74) *Attorney, Agent, or Firm*—Kratz, Quintos & Hanson, LLP.

(57) ABSTRACT

The present invention provides a vacuum heat treating method, such as carburization, carbonitridation, high temperature carburization, high concentration carburization and the like, performed while supplying a mixed gas of ethylene gas and hydrogen gas under reduced pressures. The method includes: detecting a quantity of ethylene gas and that of hydrogen gas in a vacuum heat treating furnace (1); calculating an equivalent carbon concentration of atmosphere on the basis of the detected quantity of ethylene gas and that of hydrogen gas; and comparing the calculated value with a targeted value which is set on the basis of a material specification and required heat treatment performance of an object to be treated (a workpiece), to control quantities of ethylene gas and hydrogen gas supplied into the vacuum heat treating furnace (1) on the basis of a difference between the calculated value and the targeted value. A heat treatment quality required for the workpiece can be obtained with accuracy and reproducibility.

14 Claims, 9 Drawing Sheets

VACUUM HEAT TREATING METHOD AND APPARATUS THEREFOR

TECHNICAL FIELD

The present invention relates to a vacuum heat treating method, such as carburization, carbonitridation, high temperature carburization, high concentration carburization and the like, performed while supplying a mixed gas of ethylene gas and hydrogen gas under reduced pressures, and an apparatus for implementing the method.

BACKGROUND ART

As a vacuum carburizing method of performing a carburizing process on steel parts for automobile such as gears, bearings, fuel injection nozzles and constant velocity joints, for example, a method of using ethylene gas as a carburizing gas to perform the process under reduced pressures of 1 to 10 kPa in a vacuum heat treating furnace has been known (see Japanese Unexamined Patent Publication No. 11-315363).

In the conventional method, however, when the vacuum carburization is performed while disposing a basket which carries a number of objects to be treated (workpieces) in an effective heating space where uniformity of temperature is ensured in the vacuum heat treating furnace, there arises a problem that unevenness of carburization occurs in the workpieces depending on the carried position in the basket, and variation occurs in carburization quality such as effective case depth (carburization depth) and surface carbon concentration among workpieces at different carried positions.

Thus, as a vacuum carburizing method which solves the above described problem, the present applicant has previously proposed a method of using a mixed gas of ethylene gas and hydrogen gas as a carburizing gas (see Japanese Unexamined Patent Publication No. 2001-262313).

In the vacuum carburizing method previously proposed by the present applicant, even when carburization is performed while disposing a number of workpieces in an effective space where uniformity of temperature is ensured in the vacuum heat treating furnace, it is possible to prevent unevenness of carburization from occurring in all workpieces, so that carburization quality of all the workpieces can be made uniform.

In this method, however, a technique capable of obtaining the material (specification) and required carburization quality of the workpiece with accuracy and reproducibility has not been established.

The present invention has been made in consideration of the above described current condition, and it is an object of the present invention to provide a vacuum heat treating method and apparatus therefor capable of obtaining heat treatment quality which is required for a workpiece with accuracy and reproducibility in a method disclosed in Japanese Unexamined Patent publication No. 2001-262313.

It is another object of the present invention to provide a vacuum heat treating apparatus capable of readily setting heat treating condition in accordance with the material, shape of the workpiece, ventilation condition when workpieces are loaded in a processing basket, and required heat treatment quality.

DISCLOSURE OF THE INVENTION

Disclosed herein is a vacuum heat treating method which is performed while supplying a mixed gas of ethylene gas and hydrogen gas into a depressurized vacuum heat treating furnace, comprising: detecting a quantity of ethylene gas and that of hydrogen gas in the vacuum heat treating furnace; calculating an equivalent carbon concentration of atmosphere (carbon potential) on the basis of the detected quantity of ethylene gas and that of hydrogen gas; and comparing the calculated value with a targeted value which is set on the basis of a material and required heat treatment quality of a workpiece, to control quantities of ethylene gas and hydrogen gas supplied into the vacuum heat treating furnace on the basis of a difference between the calculated value and the targeted value.

Since the quantities ethylene gas and hydrogen gas supplied are controlled so that the equivalent carbon concentration of atmosphere in the vacuum heat treating furnace, which has the most influence on the required heat treatment quality, is constant, the heat treatment quality required for the workpiece can be obtained with accuracy and reproducibility.

Disclosed herein is a vacuum heat treating method which comprises: constantly keeping the sum of the quantity of ethylene gas and that of hydrogen gas in the vacuum heat treating furnace. In this case, it is possible to obtain the heat treatment quality required for the workpiece more accurately.

Disclosed herein is a vacuum heat treating method which comprises: constantly keeping the pressure in the vacuum heat treating furnace. In this case, it is possible to obtain the heat treatment quality required for the workpiece more accurately.

Disclosed herein is a vacuum heat treating apparatus which comprises: a vacuum heat treating furnace; evacuating means for depressurizing the interior of the vacuum heat treating furnace; flow rate adjusting means for adjusting quantities of ethylene gas and hydrogen gas to be supplied into the vacuum heat treating furnace; gas quantity detecting means for detecting a quantity of ethylene gas and that of hydrogen gas in the vacuum heat treating furnace; controlling means for calculating an equivalent carbon concentration of atmosphere on the basis of the quantity of ethylene gas and that of hydrogen gas detected by the gas quantity detecting means, comparing this calculated value with a targeted value which is preset on the basis of a material and required heat treatment quality of a workpiece, and controlling quantities of ethylene gas and hydrogen gas supplied into the vacuum heat treating furnace on the basis of a difference between the calculated value and the targeted value by means of flow rate adjusting means.

Since it is possible to constantly keep the equivalent carbon concentration of atmosphere in the vacuum heat treating furnace, which has the most influence on the required heat treatment quality, the heat treatment quality required for the workpiece can be obtained with accuracy and reproducibility.

Disclosed herein is a vacuum heat treating apparatus which comprises: the controlling means controls the flow rate adjusting means so that the sum of the quantity of ethylene gas and that of hydrogen gas in the vacuum heat treating furnace is kept constant. In this case, since the sum of the quantity of ethylene gas and that of hydrogen gas in the heat treating furnace is kept constant by controlling the flow rate adjusting means by the controlling means, the heat treatment quality required for the workpiece can be obtained more accurately.

Disclosed herein is a vacuum heat treating apparatus which further includes: pressure detecting means for detecting the pressure in the vacuum heat treating furnace, wherein the controlling means compares a detection value detected by the pressure detecting means with a preset targeted value, and controls the evacuating means so that the furnace pressure is constant. In this case, since the pressure in the heat treating furnace is kept constant by controlling the evacuating means by the controlling means, the heat treatment quality required for the workpiece can be obtained more accurately.

Disclosed herein is a vacuum heat treating apparatus which comprises: a plurality of processing patterns and soaking temperatures corresponding to the material of a workpiece are set in the controlling means, and the processing pattern and the soaking temperature can be selected and inputted to the controlling means in correspondence with the material of the workpiece. In this case, settings of processing pattern and soaking temperature can be made readily.

Disclosed herein is a vacuum heat treating apparatus which comprises: a plurality of heat treating temperatures corresponding to material, shape of the workpiece and ventilation condition when one or more workpieces are loaded in a processing basket are set in the controlling means, and the heat treating temperature can be selected and inputted to the controlling means in correspondence with the material, shape and ventilation condition of the objects to be treated. In the present specification, "shape of workpiece" means general shapes such as a simple shape without hole and recess, a shape having a slot, a shape having an elongated hole and the like, rather than a special shape. A setting of heat treating temperature can be made readily.

Disclosed herein is a vacuum heat treating apparatus which comprises: a plurality of preheating times corresponding to heat treating temperature are set in the controlling means, and the preheating time can be selected and inputted to the controlling means in correspondence with the heat treating temperature. In this case, a setting of preheating time can be made readily.

Disclosed herein is a vacuum heat treating apparatus which comprises: a dimension of a processing part of the workpiece can be inputted to the controlling means, and provided that the inputted dimension of the processing part of the workpiece exceeds a predetermined value, the controlling means corrects the preheating time on the basis of the exceeded value. In this case, a setting of preheating time in accordance with the dimension of the processing part of the workpiece can be made with accuracy.

Disclosed herein is a vacuum heat treating apparatus which comprises: the controlling means determines a carburization coefficient by effective case depth on the basis of the selected and inputted heat treating temperature.

Disclosed herein is a vacuum heat treating apparatus which comprises: the controlling means calculates a total carburizing time required for carburization and diffusion on the basis of the carburization coefficient by the effective case depth, calculates a ratio between carburizing time and diffusing time on the basis of the required heat treatment quality, and determines a carburizing time and a diffusing time on the basis of these calculated values. In this case, carburizing time and diffusing time are automatically set in accordance with the required heat treatment quality.

Disclosed herein is a vacuum heat treating apparatus which further includes: a feeding/discharging chamber for one or more workpieces, which can be depressurized; and a transfer chamber which is provided adjoining the feeding/discharging chamber for one or more workpieces, and has transfer means being rotatable around the vertical axis, wherein a plurality of vacuum heat treating furnaces each having the evacuating means, the flow rate adjusting means, the gas quantity detecting means and the controlling means, and a hardening chamber and a soaking chamber both of which can be depressurized are provided with intervals in the circumferential direction around the transfer chamber via a vacuum tight door on each junction.

Since heat treatments of different processing patterns can be performed simultaneously by means of the plurality of vacuum heat treating furnaces, the apparatus is suitable for the case where the volume of production is relatively low and there are various kinds of products to be made. On the other hand, since heat treatments of the same processing pattern can be performed simultaneously by means of the plurality of vacuum heat treating furnaces, the apparatus is also suitable to the case where the volume of production is large and there are small kinds of products to be made. Therefore, it is possible to flexibly respond to variations in kind and manufacturing volume of the workpiece. In addition, since it is possible to perform maintenance of vacuum heat treating furnace, hardening chamber and soaking chamber individually, the maintenance tasks can be easily performed.

Disclosed herein is a vacuum heat treating apparatus which comprises: a gas cooling chamber which can be depressurized is provided around the transfer chamber with intervals from the vacuum heat treating furnace, the hardening chamber and the soaking chamber in the circumferential direction. In this case, it is possible to perform high temperature carburizing process including gas cooling in the processing pattern.

BEST MODE FOR CARRYING OUT THE INVENTION

Hereinafter, an embodiment of the present invention will be described with reference to the drawings.

Figure 1:
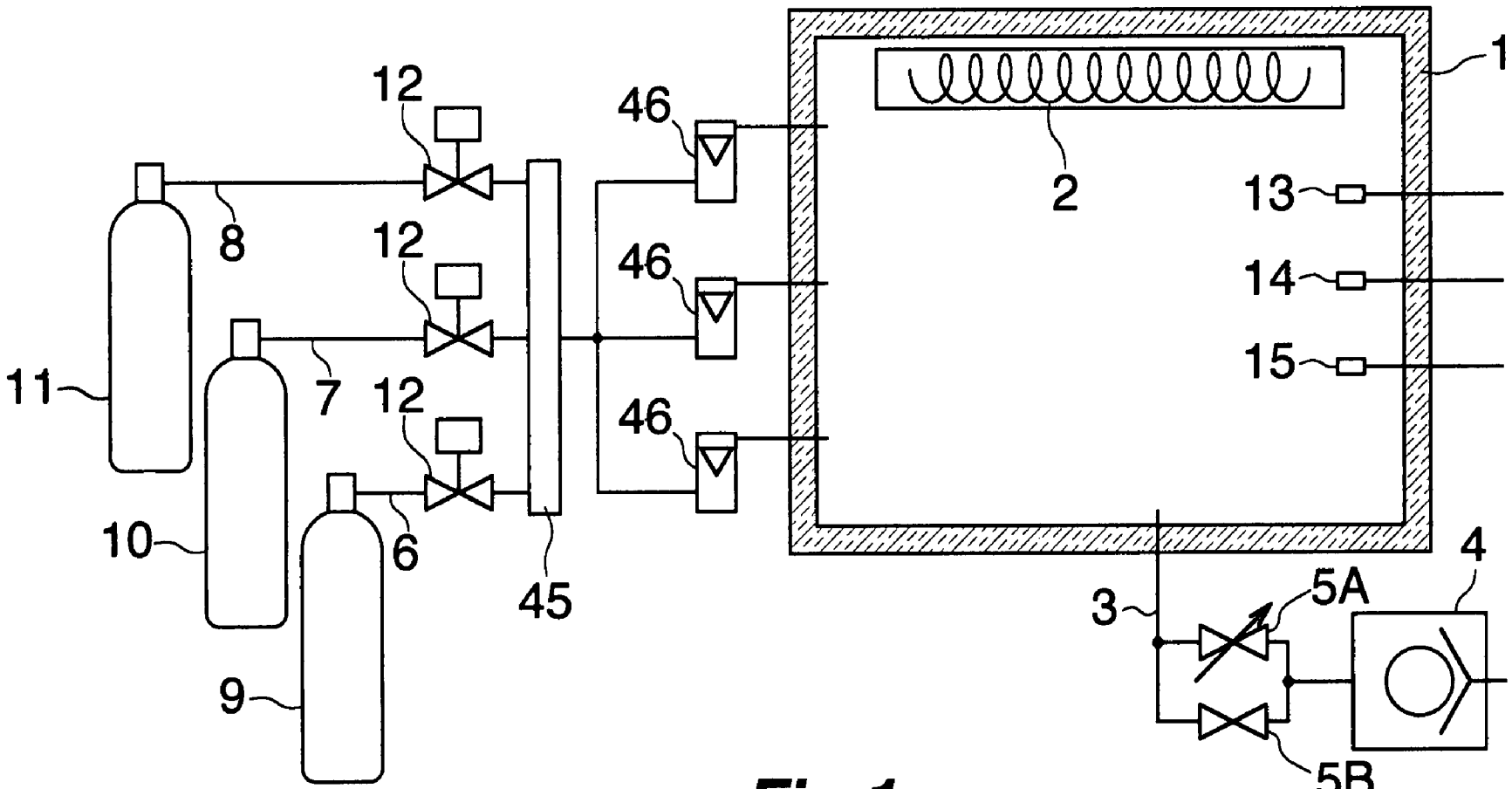
FIG. 1 is a sectional view schematically showing an entire structure of a vacuum heat treating apparatus according to the present invention.
Figure 2:
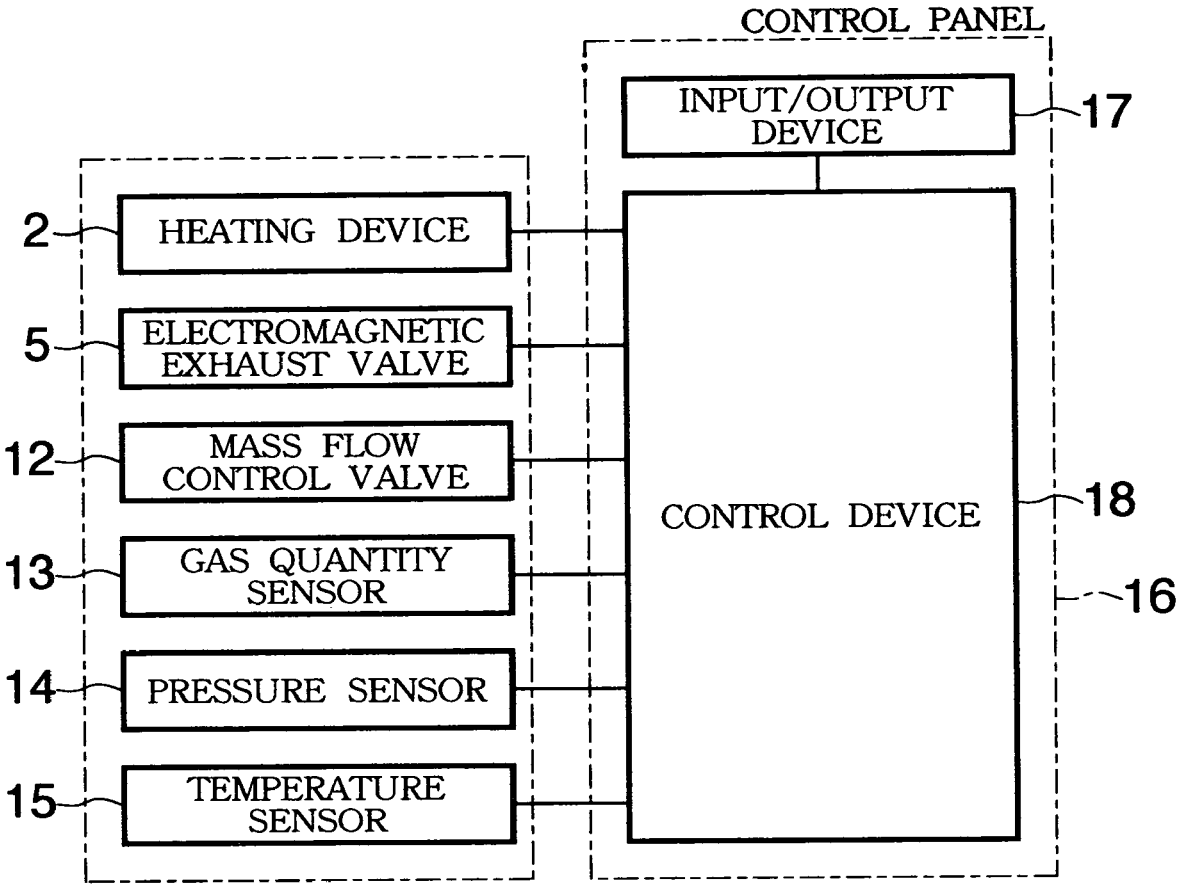
FIG. 2 is a block diagram showing a structure of a part which controls the vacuum heat treating apparatus according to the present invention.

FIG. 1 schematically shows an entire structure of the vacuum heat treating apparatus according to the present invention, and FIG. 2 shows the configuration of a part which controls the vacuum heat treating apparatus.

In FIG. 1, the vacuum heat treating apparatus includes: a vacuum heat treating furnace (1); a heating device (2) disposed in the vacuum heat treating furnace (1); a vacuum pump (4) connected to the vacuum heat treating furnace (1) via an evacuating tube (3) branched into two routes in the midway; a furnace pressure control valve (5A) provided on one of the branched routes of the evacuating tube (3); a vacuum ON/OFF valve (5B) provided in the other of the branched routes of the evacuating tube (3); a hydrogen gas cylinder (9), an ethylene gas cylinder (10) and an ammonia gas cylinder (11) connected to the vacuum heat treating furnace (1) via introducing passages (6), (7) and (8), respectively; mass flow control valves (12) provided in the respective introducing passages (6), (7) and (8); a gas quantity sensor (13), for example, a quadrupole mass spectrometric sensor for detecting quantities of hydrogen gas and ethylene gas in the heat treating furnace (1); a pressure sensor (14) for detecting absolute pressure in the vacuum heat treating furnace (1); and a temperature sensor (15) for detecting temperature of an effective heating space where uniformity of temperature is ensured in the vacuum heat treating furnace (1). The introducing passages (6), (7) and (8) are connected to a single header (45) at the points closer to the vacuum heat treating furnace (1) from the mass flow control valves (12), and branched again at the points closer to the vacuum heat treating furnace (1) from the header (45). Flow rate controllers (46) are provided at the points of the introducing passages (6), (7) and (8) where they are branched again. Hydrogen gas, ethylene gas and ammonia gas fed from the gas cylinders (9), (10) and (11) are separated again after mixed in the header (45); and introduced in the vacuum heat treating furnace (1) so that they are uniformly spread through the vacuum heat treating furnace (1) via the function of the flow rate controllers (46).

Though not shown in the figure, in the vacuum heat treating apparatus shown in FIG. 1, a quenchant oil tank is sometimes provided adjoining the vacuum heat treating furnace (1).

As shown in FIG. 2, the heating device (2), the furnace pressure control valve (5A), the mass flow control valve (12), the gas quantity sensor (13), the pressure sensor (14) and the temperature sensor (15) are connected to a control panel (16). The control panel (16) is provided with an input/output device (17) having a display and a control device (18).

Figure 3:
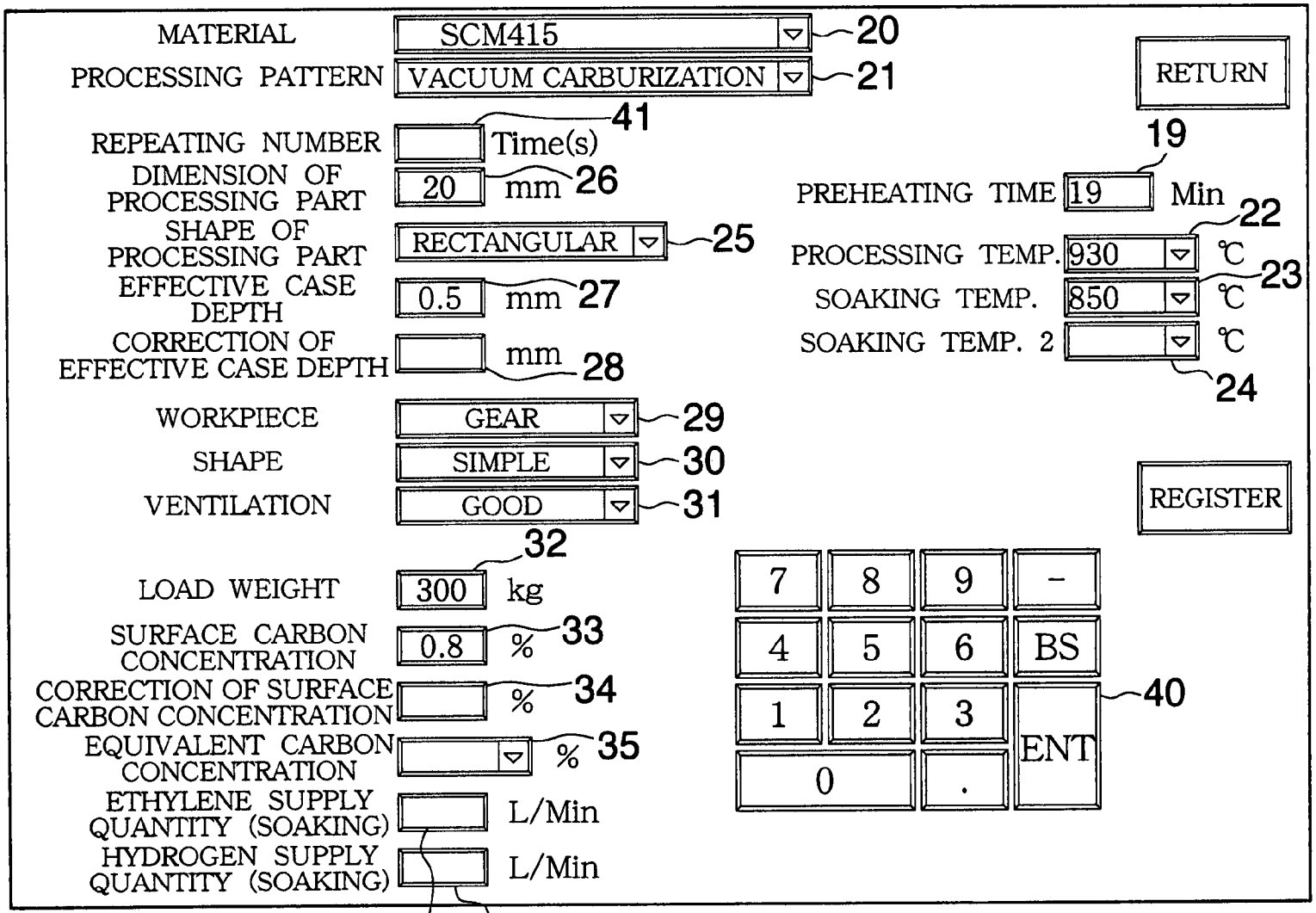
FIG. 3 is a view showing one example of an inputting screen displayed on a display of an input/output device.

FIG. 3 shows one example of an inputting screen displayed in the display of the input/output device (17). In FIG. 3, the inputting screen includes: a material selecting/inputting portion (20) for inputting a material; a processing pattern selecting/inputting portion (21) for inputting a processing pattern; a preheating time selecting/inputting portion (19) for inputting a preheating time; a heat treating temperature selecting/inputting portion (22) for inputting a carburizing temperature; a soaking temperature selecting/inputting portion (23) for inputting a soaking temperature; a second soaking temperature selecting/inputting portion (24) for inputting a second soaking temperature in the case of a high concentration carburizing process; a repeating number inputting portion (41) for inputting the number of repetition in the case of a high concentration carburizing process; a shape of processing part selecting/inputting portion (25) for inputting a shape of the processing part where a desired heat treatment quality is required for a workpiece; a dimension of processing part selecting/inputting portion (26) for inputting a dimension of the processing part where a desired heat treatment quality is required for the workpiece; an effective case depth inputting portion (27) for inputting an effective case depth; an effective case depth correcting/inputting portion (28) for inputting a correction value of the effective case depth; a workpiece selecting/inputting portion (29) for selecting and inputting a kind of the workpiece; a shape selecting/inputting portion (30) for inputting a shape of the workpiece; a ventilation condition selecting/inputting portion (31) for selecting and inputting ventilation condition when the workpieces are loaded in a processing basket; a load weight inputting portion (32) for inputting a total weight of the workpieces loaded in a basket disposed in the effective heating space where uniformity of temperature is ensured in the vacuum heat treating furnace (1); a surface carbon concentration inputting portion (33) for inputting a required surface carbon concentration; a surface carbon concentration correcting/inputting portion (34) for inputting a correction value of the surface carbon concentration; an equivalent carbon concentration selecting/inputting portion (35) for selecting and inputting a targeted equivalent carbon concentration of atmosphere; an ethylene supply quantity display portion (36) for displaying a quantity of ethylene gas supplied; a hydrogen supply quantity display portion (37) for displaying a quantity of hydrogen gas supplied; and a numerical key portion (40).

The control device (18) stores a plurality of materials of the workpiece, processing patterns and soaking temperatures corresponding to materials of the workpiece, heat treating temperatures (which are equal to the preheating temperatures and the diffusing temperatures), and preheating times corresponding to heat treating temperatures. By selecting and inputting the material of the workpiece from the selecting/inputting portion (20) of the input/output device (17), a processing pattern, a soaking temperature, a heat treating temperature corresponding to the material of the workpiece, and a preheating time corresponding to the heat treating temperature are automatically selected and inputted from the respective selecting/inputting portions (21), (23), (22) and (19) to the control device (18). The processing pattern, soaking temperature and heat treating temperature corresponding to the material of the workpiece, and the preheating time corresponding to the heat treating temperature can also be manually selected and inputted individually from the respective selecting/inputting portions (21), (23), (22) and (19) of the input/output device (17) by a user. Setting values of the material processing pattern, soaking temperature and heat treating temperature, and the preheating time corresponding to the heat treating temperature may be set uniquely by the user with the input/output device (17).

Processing patterns set on the control device (18) are shown in FIGS. 4 to 8.

Figure 4:
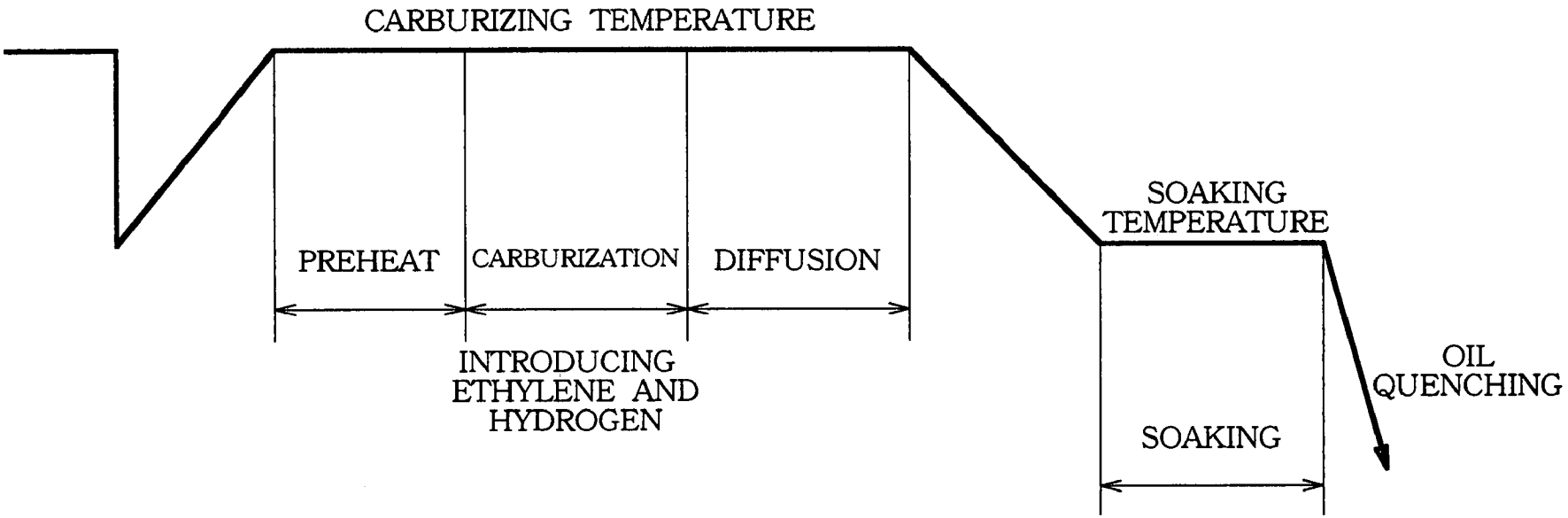
FIG. 4 is a diagram showing a processing pattern of a vacuum carburizing process.

The processing pattern shown in FIG. 4 is for a vacuum carburizing process which involves: preheating by heating to a predetermined preheating temperature under reduced pressures; carburizing at a carburizing temperature which is equal to the preheating temperature while introducing ethylene gas and hydrogen gas; performing diffusion at a diffusing temperature which is equal to the preheating temperature and carburizing temperature, followed by soaking after lowering the temperature; and finally performing oil quenching.

Figure 5:
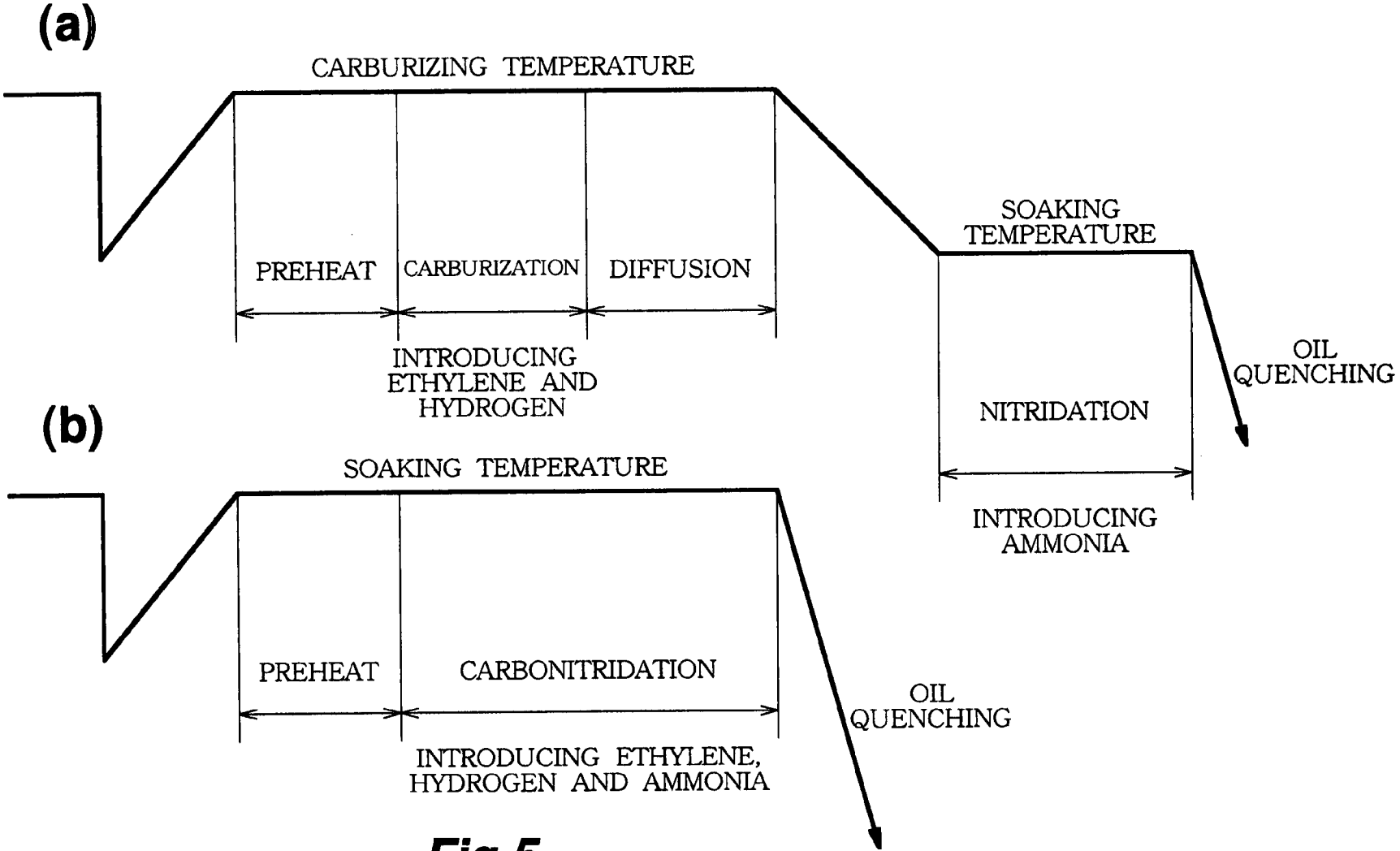
FIGS. 5(*a*) and 5(*b*) are diagrams showing processing patterns of vacuum carbonitriding processes.

The processing pattern shown in FIG. 5(*a*) is for a vacuum carbonitriding process which involves: preheating by heating to a predetermined preheating temperature under reduced pressures; carburizing at a carburizing temperature which is equal to the preheating temperature while introducing ethylene gas and hydrogen gas; performing diffusion at a diffusing temperature which is equal to the preheating temperature and the carburizing temperature, followed by soaking after lowering the temperature as well as performing nitridation while introducing ammonia gas during the soaking; and finally performing oil quenching. During the nitridation which is performed while introducing ammonia gas, ethylene gas and hydrogen gas can also be introduced.

As another processing pattern for a vacuum carbonitriding process, there is a pattern as shown in FIG. 5(*b*) which lacks carburization and diffusion, and involves: preheating by heating to a soaking temperature of FIG. 5(*a*) under reduced pressures; performing carbonitridation while introducing ethylene gas, hydrogen gas and ammonia gas after completion of the preheating; and finally performing oil quenching. In the case of this processing pattern, since the time for carburizing process is zero in the carbonitriding process and a carburizing process is not included, the soaking temperature is equal to the carbonitriding temperature.

Figure 6:
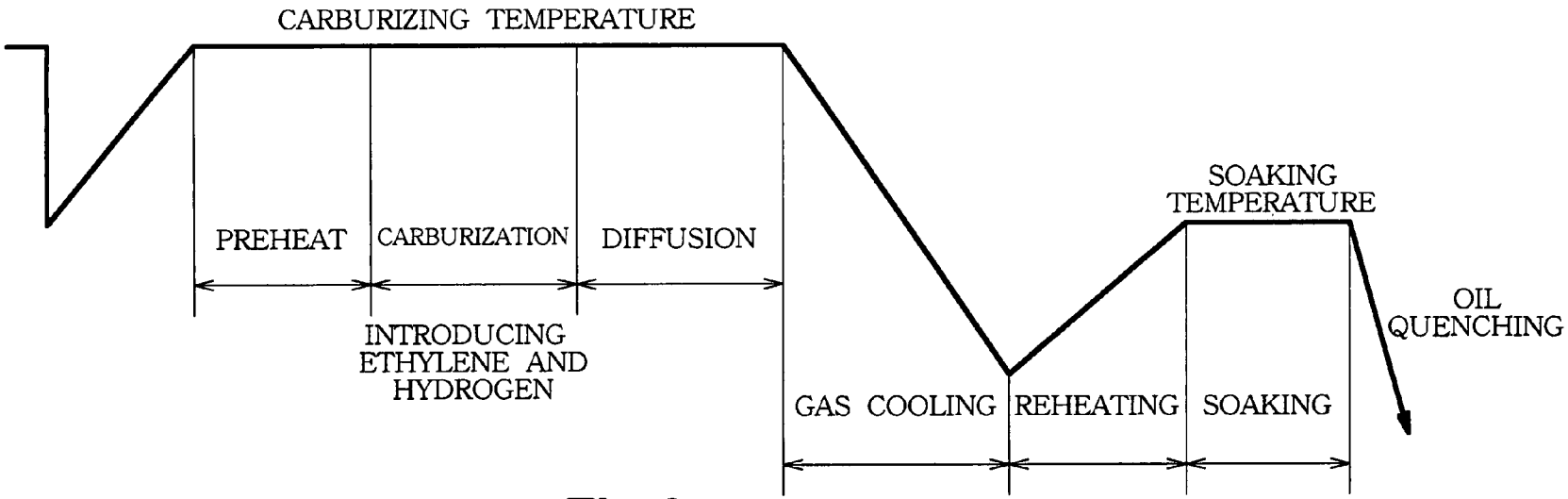
FIG. 6 is a diagram showing a processing pattern of a high temperature vacuum carburizing process.

The processing pattern shown in FIG. 6 is for a high temperature vacuum carburizing process which involves: preheating by heating to a predetermined preheating temperature under reduced pressures; performing carburization at a carburizing temperature which is equal to the preheating temperature while introducing ethylene gas and hydrogen gas; performing diffusion at a diffusing temperature which is equal to the carburizing temperature, followed by gas cooling, then performing soaking by heating again up to a predetermined soaking temperature; and finally performing oil quenching The high temperature carburizing process includes a process step for refining crystal grains which have grown to large size during carburization at such high temperature.

Figure 7:
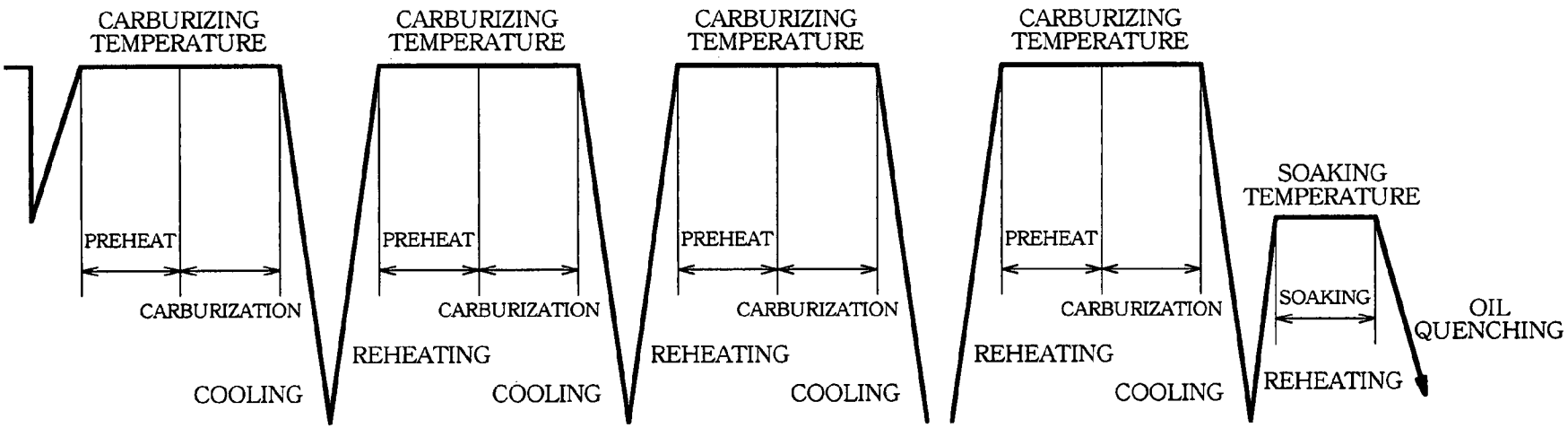
FIG. 7 is a diagram showing a processing pattern of a high concentration vacuum carburizing process.

The processing pattern shown in FIG. 7 is for a high concentration vacuum carburizing process which involves: repeatedly performing a process of preheating by heating to a predetermined preheating temperature under reduced pressures, performing carburization at a carburizing temperature which is equal to the preheating temperature while introducing ethylene gas and hydrogen gas, followed by gas cooling, preheating by heating again up to the preheating temperature which is equal to the above preheating temperature, and performing carburization at a carburizing temperature which is equal to the preheating temperature while introducing ethylene gas and hydrogen gas, followed by gas cooling, to a predetermined times; soaking by heating to a soaking temperature which is lower than the carburizing temperature after the final gas cooling; and finally performing oil quenching. The high concentration carburizing process is a process for obtaining carbides precipitates by gas cooling and growing the carbides while spheroidizing the same. In the case of the high concentration vacuum carburizing process, a number of repetition is inputted to the repeating number inputting portion (41) of the input/output device (17) and a soaking temperature is selected and inputted from the second soaking temperature selecting/inputting portion (24).

Figure 8:
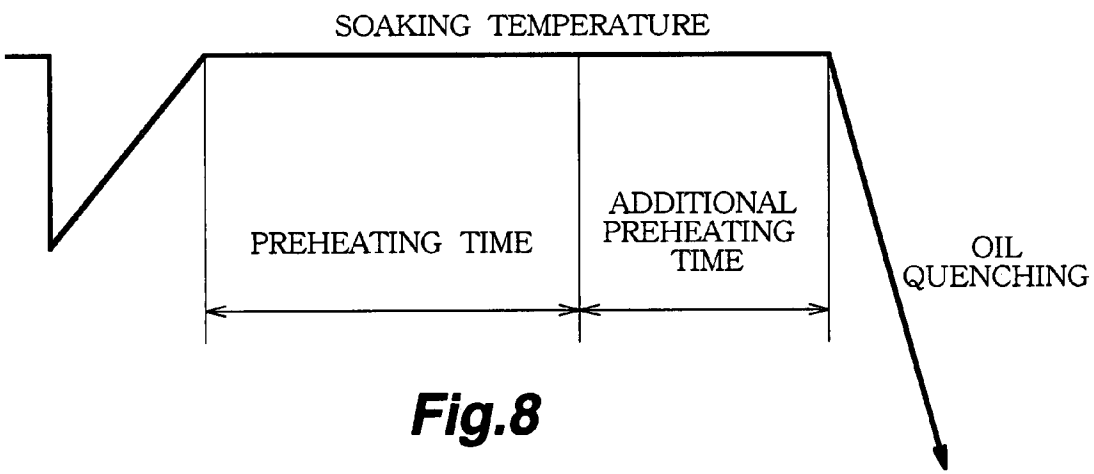
FIG. 8 is a diagram showing a processing pattern of a vacuum hardening process.

The processing pattern shown in FIG. 8 is for a vacuum hardening process which involves: preheating by heating to a preheating temperature which is equal to the soaking temperature in the processing patterns of FIGS. 4 to 6 under reduced pressures; and thereafter performing oil quenching.

The processing pattern and soaking temperature may be automatically selected and inputted by selecting and inputting a material of a workpiece from the material selecting/inputting portion (20) of the input/output device (17). In the case where the processing pattern is for a vacuum hardening process, since a carburizing process is not, included, the soaking temperature is equal to the preheating temperature.

The heat treating temperature, that is, the carburizing temperature is determined on the basis of the shape of the workpiece,the ventilation condition when the workpieces are loaded on the processing basket, and required heat treatment quality.

The preheating time is experimentally determined on the basis of the heat treating temperature. Relationship between heat treating temperature and preheating time is shown in Table 1.

TABLE 1

| Heat treating temperature (° C.) | Minimum preheating time (min) |
|---|---|
| 850 | 75 |
| 870 | 65 |
| 930 | 40 |
| 950 | 35 |
| 1050 | 30 |

When a dimension of the processing part of the workpiece inputted from the input/output device (17) exceeds a predetermined dimension, the control device (18) corrects the preheating time in correspondence with a heat treating temperature on the basis of the excess value. For example, in the case where the processing part where a certain heat treatment quality is required in the workpiece has a circular cross section, when the diameter T1 thereof exceeds 25 mm, the preheating time is corrected in accordance with the formula shown in Table 2. In the case where the processing part where a certain heat treatment quality is required in the workpiece has a quadrate cross section, when the length of one side T2 exceeds 25 mm, the preheating time is corrected in accordance with the formula shown in Table 2. In the case where the processing part where a certain heat treatment quality is required in the workpiece has a rectangular cross section, when the length of short side T3 exceeds 25 mm, the preheating time is corrected in accordance with the formula shown in Table 2. In the case where the processing part where a certain heat treatment quality is required in the workpiece has a cylindrical cross section, when the length of short side T4 exceeds 25 mm, the preheating time is corrected in accordance with the formula shown in Table 2.

TABLE 2

| Heat treating temperature (° C.) | Shape | | | |
|---|---|---|---|---|
| | Circular | Quadrate | Rectangular | Cylindrical |
| 850 to 870 | (T1-25) × 1.5 | (T2-25) × 1.8 | (T3-25) × 2.1 | (T4-25) × 3.0 |
| 930 | (T1-25) × 0.8 | (T2-25) × 1.0 | (T3-25) × 1.1 | (T4-25) × 1.6 |
| 950 | (T1-25) × 0.7 | (T2-25) × 0.9 | (T3-25) × 1.0 | (T4-25) × 1.4 |
| 1050 | (T1-25) × 0.6 | (T2-25) × 0.7 | (T3-25) × 0.8 | (T4-25) × 1.2 |

In the rows for shape in Table 2, the circular, quadrate and rectangular respectively mean cross section shapes.

The control device (18) stores plural settings for shape of the processing part where a desired heat treatment quality is required in the workpiece, kind of the workpiece, shape of the workpiece, and ventilation condition when the workpieces are loaded in a processing basket, and accepts selection and input from the respective selecting/inputting portions (25), (29), (30) and (31).

Figure 9:
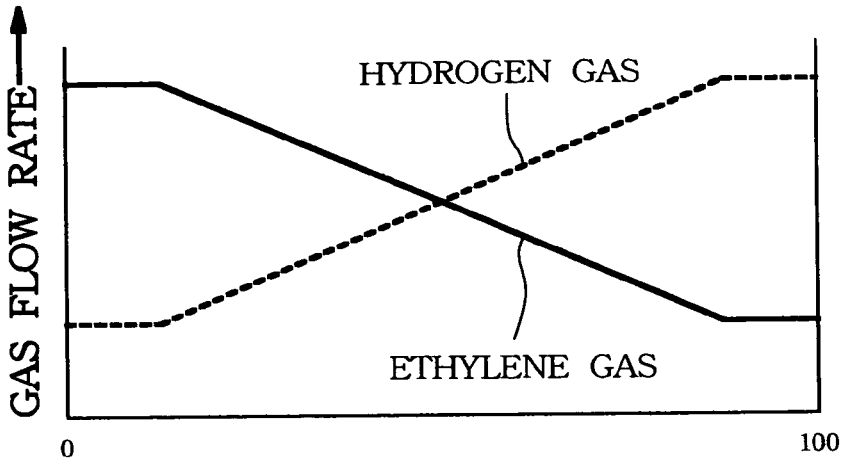
FIG. 9 is a graph showing relationship between quantity of ethylene gas supplied and that of hydrogen gas supplied in a vacuum heat treatment which is performed while supplying ethylene gas and hydrogen gas.

The control device (18) stores plural settings of equivalent carbon concentration in the processing atmosphere that are experimentally determined for obtaining required surface carbon concentration and effective case depth, the plural settings of equivalent carbon concentration in correspondence with materials of the workpieces and used as a targeted value. By selecting and inputting the material of the workpiece from the selecting/inputting portion (20) of the input/output device (17), and by inputting a surface carbon concentration and an effective case depth from the respective inputting portions (34) and (27) of the input/output device (17), a corresponding equivalent carbon concentration is automatically inputted from the equivalent carbon concentration selecting/inputting portion (35) of the input/output device (17). It is noted that the equivalent carbon concentration of atmosphere may be manually selected and inputted from the selecting/inputting portion (35) of the input/output device (17) by the user. Further, the setting values of equivalent carbon concentration of atmosphere may be uniquely determined by the user with the input/output device (17). The control device (18) detects the quantity of ethylene gas and that of hydrogen gas in the vacuum heat treating furnace (1) by the gas quantity sensor (13), calculates equivalent carbon concentration of atmosphere on the basis of the detected quantity of ethylene gas and that of hydrogen gas, compares the calculated value with the above targeted value, and adjusts the opening degree of the mass flow control valve (12) on the basis of a difference between the calculated value and the targeted value, thereby controlling the quantities of ethylene gas and hydrogen gas supplied into the vacuum heat treating furnace (1). At this time, as shown in FIG. 9, the flow rates of these gases are controlled so that the total quantity of the quantity of ethylene gas and that of hydrogen gas is constant.

Equivalent carbon concentration of atmosphere Ac (%) is calculated in accordance with the following formula 1:

$$Ac = \frac{As \times X_{C_2H_4}^{\frac{1}{2}} \times Kp^{\frac{1}{2}}}{X_{H_2}} \times \left(\frac{P}{P^o}\right)^{\frac{1}{2}} \quad \text{formula 1}$$

wherein

As: Saturated carbon concentration of austenite (%), $X_{H2}$: Ratio of hydrogen concentration (ratio by molar), $X_{C2H4}$: Ratio of ethylene concentration (ratio by molar), P: Furnace pressure, $P_0$: Standard pressure (101.32 kPa), and Kp: Equilibrium constant.

Herein, the saturated carbon concentration As of austenite and the equilibrium constant Kp are respectively represented by the following formulae 2 and 3:

$$As = 1.382 - 4.5847 \times 10^{-3} \times T + 6.1437 \times 10^{-6} \times T^2 - 1.396 \times 10^{-9} \times T^3 \quad \text{formula 2}$$

wherein

T: Temperature (° C.), $$Kp = 10^{\left(\frac{2273}{T_k} + 4.011\right)} \quad \text{formula 3}$$

wherein

Tk: Absolute temperature (K).

The above formula 1 determines Ac on the basis of the formula of equilibrium in the steady state while assuming that the reaction of $C_2H_4 \rightarrow 2C + 2H_2$ occurs in the atmosphere. In various studies for knowing which kind of formula is suitable for determining equivalent carbon concentration of atmosphere, the formula 1 was the most approximate to results of experiment, and hence this formula 1 was adopted. The formula 2 calculates As by polynomial approximation on the basis of the binary alloy of Fe—C system, however. As may be determined by polynomial approximation on the basis of other alloys such as ternary alloy, or may be determined by exponential approximation. The formulae 1 to 3 may change in various ways depending on the characteristics of the vacuum heat treating furnace, i.e., structure, size and the like of the vacuum heat treating furnace.

Table 3 shows calculation examples of equivalent carbon concentration of atmosphere.

TABLE 3

| Calculation example | Temperature (° C.) | Absolute temperature (K) | $X_{H2}$ Ratio by molar | $X_{C2H4}$ Ratio by molar | As (%) | Kp | P (Pa) | $P_0$ (Pa) | Ac (%) |
|---|---|---|---|---|---|---|---|---|---|
| 1 | 950 | 1223 | 8.28E−01 | 9.76E−02 | 1.37 | 740533.2 | 5985 | 1.01E+05 | 108.52 |
| 2 | 870 | 1143 | 5.15E−01 | 3.71E−01 | 1.12 | 999140.2 | 4655 | 1.01E+05 | 284.74 |
| 3 | 1040 | 1313 | 4.30E−01 | 1.66E−01 | 1.69 | 552268.2 | 8000 | 1.01E+05 | 334.04 |
| 4 | 930 | 1203 | 3.96E−01 | 2.64E−01 | 1.31 | 795139 | 1800 | 1.01E+05 | 201.9 |
| 5 | 870 | 1143 | 7.62E−01 | 1.36E−01 | 1.12 | 999140.2 | 7000 | 1.01E+05 | 143.05 |
| 6 | 930 | 1203 | 8.73E−01 | 6.81E−02 | 1.31 | 795139 | 5000 | 1.01E+05 | 77.54 |
| 7 | 950 | 1223 | 8.68E−01 | 6.44E−02 | 1.37 | 740533.2 | 5000 | 1.01E+05 | 76.84 |

In Table 3, for example, 8.28E−01 means $8.28\times10^{-1}$ as is known in the art.

In addition, for keeping the furnace pressure (absolute pressure) at a constant pressure of 4 to 7 kPa, the control device (18) detects the pressure in the vacuum heat treating furnace (1) by means of the pressure sensor (14), compares the detected value thus detected with a preset targeted value, and controls the opening degree of the furnace pressure control valve (5A) so that the furnace pressure is constant.

Controls of the ethylene gas flow rate and hydrogen gas flow rate, and control of the furnace pressure are performed by feedback control according to PID.

On the basis of the inputted heat treating temperature, the control device (18) determines the total carburizing time in the manner as will be described below. In the present specification, the term "total carburizing time" means the sum of carburizing time and diffusing time in the processing patterns shown in FIGS. 4 to 6.

Figure 10:
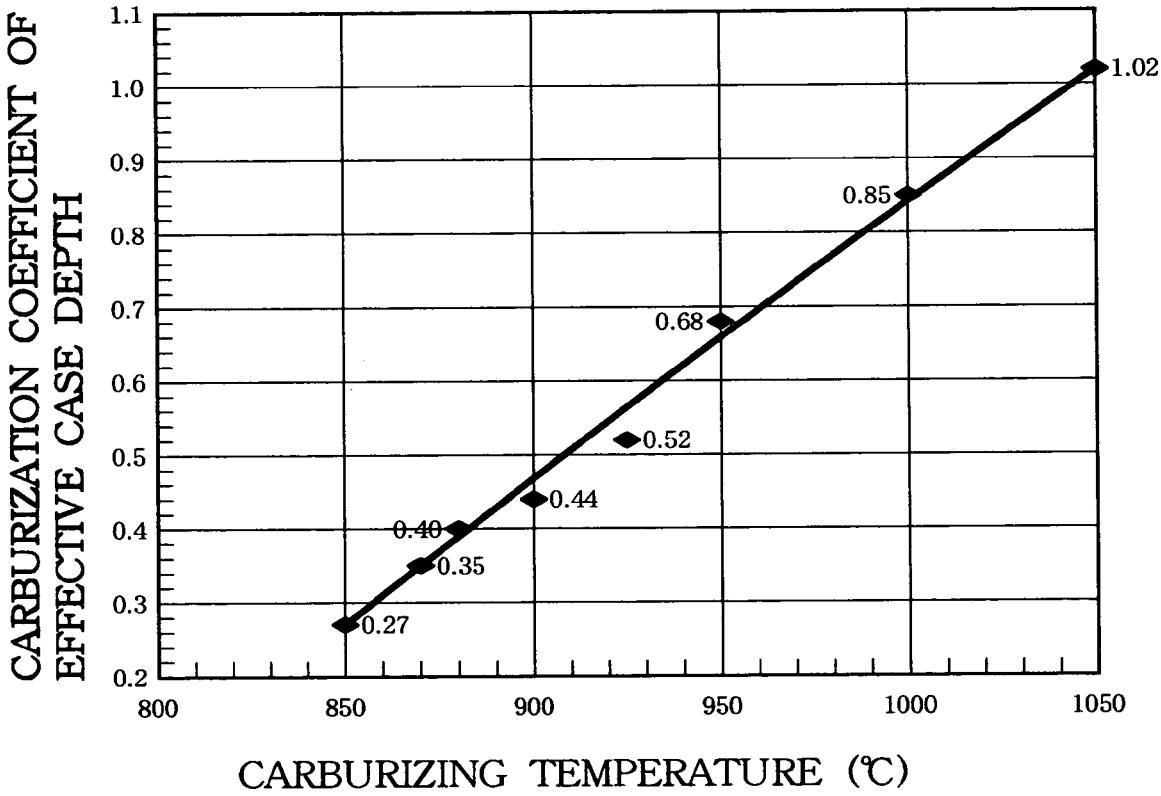
FIG. 10 is a graph showing relationship between carburizing temperature and carburization coefficient by effective case depth which is experimentally determined.

$K_{ECD}$ by an effective case depth which achieves a surface hardness of HV550 when treated at each carburizing temperature is experimentally determined in advance, and this value is inputted into the control device (18). In the following description,"carburization coefficient by effective case depth" is simply referred to as "carburization coefficient". The experiment was performed using a test piece made of, for example, JIS SCM415 having a diameter of 24 mm and a thickness of 10 mm. The experiment includes: performing a vacuum carburizing process under the condition of various temperatures in the range of 870 to 1050° C. pressures of 4 to 7 kPa, flow rates of ethylene gas of 10 to 20 L/min and flow rates of hydrogen gas of 5 to 10 L/min, total carburizing time of 100 to 270 minutes and the ratio of carburizing time and diffusing time of 0.05 to 2.24; performing soaking at 850° QC. for 30 minutes after lowering the temperature, and quenching in a hot quenchant oil (HIGH TEMP A manufactured by IDEMITSU Kosan Co., Ltd.) having an oil temperature of 110 to 130° QC. and a oil level pressure of 80 kPa. The relationship between carburizing temperature and carburization coefficient $K_{ECD}$ determined via such experiments is shown in FIG. 10.

Then the control device (18) calculates total carburizing time tt (min) using effective case depth DECD and carburization coefficient $K_{ECD}$ according to the following formula 4:

$$t_t=(D_{ECD}+D_{ECD}'/K_{ECD})^2\times60 \qquad \text{formula 4}$$

In the above formula, $D_{ECD}'$ represents a correction value of effective case depth which is usually zero, and when an effective case depth of the workpiece which has actually been subjected to the heat treatment deviates from the targeted value, this correction value is inputted to the control device (18) from the effective case depth correcting/inputting portion (28) of the input/output device (17).

In addition, the control device. (18) determines ratio of carburizing time and diffusing time ($R_{D/C}$) in the manner as will be described blow on the basis of the required surface carbon concentration that has been inputted.

Relationship between surface carbon concentration and ratio ($R_{D/C}$) is determined in advance by a series of experiments performed at different carburizing temperatures, and the relationship is inputted into the control device (18). The experiment is performed using a test piece made of, for example, JIS SCM415 having a diameter of 24 mm and a thickness of 10 mm. The experiment includes: performing a vacuum carburizing process in the condition of various temperatures in the range of 870 to 1050° C. pressures of 4 to 7 kPa, a flow rate of ethylene gas of 10 to 20 L/min and flow rates of hydrogen gas of 5 to 10 L/min, a total carburizing time of 100 to 270 minutes and the ratio of carburizing time and diffusing time of 0.05 to 2.24; performing soaking at 850° QC. for 30 minutes after lowering the temperature; and hardening in a hot hardening oil (HIGH TEMP A manufactured by IDEMITSU Kosan Co., Ltd.) having an oil temperature of 110 to 130° C. and a oil level pressure of 80 kPa. The relationship between surface carbon concentration ($C_H$) and ratio ($R_{D/C}$) thus obtained is shown for each carburizing temperature in Table 4.

TABLE 4

| Processing temperature (° C.) | Relationship between $C_H$ and $R_{D/C}$ | Applicable range ($C_H$) |
|---|---|---|
| 870 | $R_{D/C} = -2.0367C_H + 2.628$ | 0.9 to 1.2 wt % |
| 900 | $R_{D/C} = -1.6667C_H + 2.2167$ | 0.8 to 1.2 wt % |
| 930 | $R_{D/C} = 0.6643 \times (C_H)^{-3.3049}$ | 0.6 to 1.0 wt % |
| 950 | $R_{D/C} = 0.8146 \times (C_H)^{-3.2135}$ | 0.6 to 1.3 wt % |
| 1000 | $R_{D/C} = -1.7429C_H + 2.8181$ | 0.7 to 1.6 wt % |
| 1050 | $R_{D/C} = 0.6792(C_H)^2 - 3.1065C_H + 3.5507$ | 0.7 to 2.3 wt % |

Then the control device (18) calculates temperature lowering speed from the inputted load weight of the workpieces to the basket, in accordance with the following formula 5, and calculates temperature lowering time on the basis of the calculated temperature lowering speed and carburizing temperature and inputted soaking temperature, in accordance with the following formula 6:

$$Vm=-0.0032\times W+2.5743 \qquad \text{formula 5}$$

$$t_m=(Tc-Ts)/Vm \qquad \text{formula 6}$$

wherein

Vm:Temperature lowering speed (° C./min),

W: Load weight (kg), $t_m$: Temperature lowering time (min),

Tc: Carburizing temperature (° C.), and

Ts: Soaking temperature (° C.)

Since the temperature lowering speed and the temperature lowering time change in various manners depending on characteristics of the vacuum heat treating furnace (1), load weight of the workpiece, and ventilation condition when the workpieces are loaded on the processing basket, the above formula 5 is determined experimentally.

Herein, the ratio ($R_{D/C}$) between carburizing time and diffusing time is expressed by the following formula 7 in consideration of the temperature lowering time:

$$R_{D/C} = \frac{t_d + \frac{t_m}{2}}{t_c} \quad \text{formula 7}$$

The control device (18) calculates carburizing time from the ratio between carburizing time and diffusing time of Table 4, the total carburizing time and the temperature lowering time in accordance with the following formula 8, and calculates diffusing time from the calculated carburizing time and the total carburizing time in accordance with the following formula 9 to make a setting using the results:

$$t_c = \frac{t_t + \frac{t_m}{2}}{1 + R_{D/C}} \quad \text{formula 8}$$

$$t_d = t_t - t_c \quad \text{formula 9}$$

in which $t_c$: Carburizing time (min), $t_t$: Total carburizing time (min), $t_m$: Temperature lowering time (min), and $t_d$: Diffusing time (min).

It is noted that the formulae 7 and 8 may be changed depending on various conditions.

On the control device (18), the soaking time is initially set at, for example, 30 minutes as an initial value. The initial value of the soaking time can be changed appropriately.

Hereinafter, a vacuum heat treating method using the above-mentioned vacuum heat treating apparatus will be described.

First, when the material of the processing workpiece is selected and inputted from the material selecting/inputting portion (20) of the input/output device (17) of the control panel (16), the processing pattern, the heat treatment temperature, the soaking temperature, the preheating time, and the equivalent carbon concentration of atmosphere which is a targeted value are automatically selected and inputted from the respective selecting/inputting portions (21), (22), (23), (19) and (35). Additionally, a kind of the workpiece, an entire shape, ventilation condition when loaded in the basket, and a shape of the processing part where a desired heat treatment quality is required in the workpiece are selected/inputted from the respective selecting/inputting portions (29), (30), (31) and (25), and a load weight of the workpieces loaded in the processing basket, an effective case depth, and a surface carbon concentration are inputted from the respective inputting portions (32), (27) and (33).

Then, when the dimension of the processing part where a desired heat treatment quality is required in the workpiece inputted from the input/output device (17) exceeds a predetermined dimension, the control device (18) corrects the preheating time on the basis of the excess value while referring to Table 2. Also, the control device (18) calculates total carburizing time and ratio between carburizing time and diffusing time on the basis of the heat treatment temperature thus inputted, and thereby determining carburizing time and diffusing time. In this manner, conditions of heat treatment are determined. The carbonitridation time in the processing pattern of FIG. 5(*b*) is manually inputted.

When the vacuum heat treatment starts, the control device (18) opens the vacuum ON/OFF valve (5B) for reducing the pressure of the vacuum heat treating furnace (1) to a predetermined pressure, and thereafter heats the interior of the furnace by means of the heating device (2) so as to perform the vacuum heating treatment in any of processing patterns shown in FIGS. 4 to 8. Once the internal pressure of the vacuum heat treating furnace (1) is reduced to a predetermined pressure, the vacuum ON/OFF valve (5B) is closed.

In the case of four processing patterns other than the vacuum hardening shown in FIG. 8, that is, in the cases which involve carburization or carbonitridation, the control device (18) detects the quantity of ethylene gas and that of hydrogen gas in the vacuum heat treating furnace (1) by means of the gas quantity sensor (13) at the time of carburization, nitridation and carbonitridation, calculates equivalent carbon concentration of atmosphere on the basis of the detected quantity of ethylene gas and that of hydrogen gas, compares the calculated value with a targeted value, adjusts the opening degree of the mass flow control valve (12) on the basis of a difference between the calculated value and the targeted value for controlling the supply quantities of ethylene gas and hydrogen gas to the vacuum heat treating furnace (1), while controlling the flow rates of these gases so that the sum of the quantity of ethylene gas and that of hydrogen gas is constant. Also, the control device (18) detects the internal pressure of the vacuum heat treating furnace (1) by means of the pressure sensor (14), compares the detection value thus detected with a targeted value that is set in advance, 4 to 7 kPa in this case, and controls the opening degree of the furnace pressure control valve (5A) so that the furnace pressure is constant. In the cases of nitridation and carbonitridation, the control device (18) adjusts the opening degree of the mass flow control valve (12) so that the quantity of ammonia gas supplied into the vacuum heat treating furnace (1) is a constant amount, for example 20 L/min.

In this manner, a vacuum heat treatment in a specific processing pattern is performed on the workpieces.

In the case where the effective case depth and the surface carbon concentration of the workpieces which have been subjected to the process deviate from predetermined values, the heat treatment to be performed for the next time under the same condition is executed while inputting correction values into the effective case depth correcting/inputting portion (28) and the surface carbon concentration correcting/inputting portion (34) of the input/output device (17). To be more specific, when the effective case depth and the surface carbon concentration are larger than predetermined values, negative values are inputted, whereas when they are smaller than predetermined values, positive values are inputted.

Figure 11:
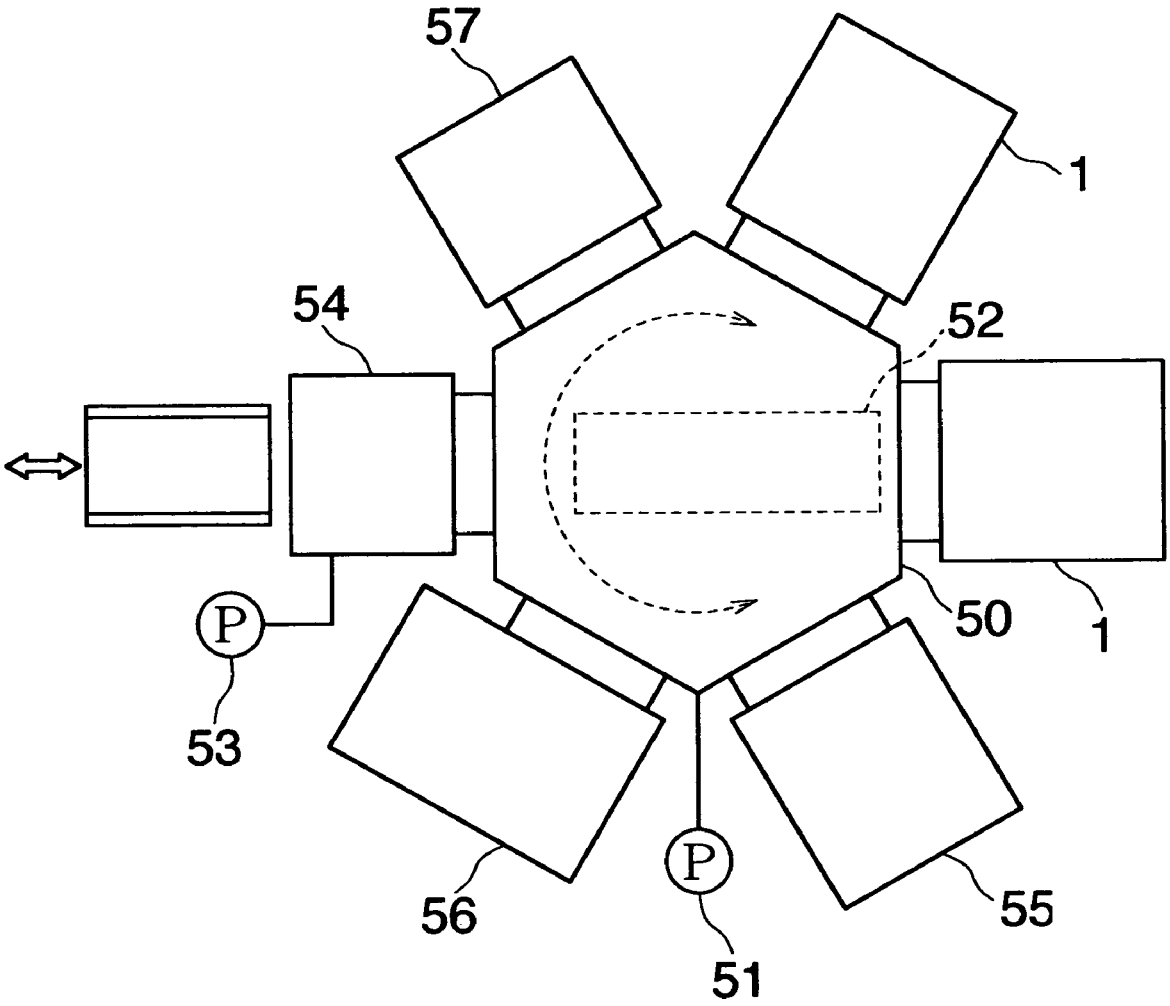
FIG. 11 is a schematic configuration view showing another embodiment of the vacuum heat treating apparatus according to the present invention

FIG. 11 shows another embodiment of the vacuum heat treating apparatus according to the present invention.

In FIG. 11, the vacuum heat treating apparatus includes: a transfer chamber (50) depressurized by a vacuum pump (51); and a transfer device (52) provided in the transfer chamber (5) so as to rotate in the transfer chamber (50) around the vertical axis. In addition to rotation, the transfer device (52) can move vertically and linearly on a horizontal surface.

Around the transfer chamber (50) are provided a workpiece feeding/discharging chamber (54) which can be depressurized by a vacuum pump (53), a plurality of vacuum heat treating furnaces (1), a soaking chamber (55), a gas cooling chamber (56) and a hardening chamber (57) depressurized by a vacuum pump (not shown) with intervals in the circumferential direction. Each vacuum heat treating furnace (1) has the same structure as shown in FIG. 1, and includes, though not shown in the figure, a heating device, a vacuum pump connected via an evacuating tube, a furnace pressure control valve and a vacuum ON/OFF valve provided in the evacuating tube, a hydrogen gas cylinder, an ethylene gas cylinder and an ammonia gas cylinder, each connected via an introducing tube, a mass flow control valve provided on each introducing tube, a gas quantity sensor, a pressure sensor and a temperature sensor. A heating device, a furnace pressure control valve and a vacuum ON/OFF valve, a mass flow control valve, a gas quantity sensor, a pressure sensor and a temperature sensor of each vacuum heat treating furnace (1) are respectively connected to a control panel which is similar to that shown in FIG. 2.

Between the transfer chamber (50), and the workpiece feeding/discharging chamber (54), each vacuum heat treating furnace (1), the soaking chamber (55), the gas cooling chamber (56) and the hardening chamber (57) are provided communication ports, and the communication ports are arranged to be opened/closed by vacuum tight doors. Workpieces which are fed into the workpiece feeding/discharging chamber are transferred between each vacuum chamber and each heat treating furnace (1) via communication port by means of the transfer device (52).

In a vacuum heat treatment by using the vacuum heat treating apparatus as described above, processes other than soaking, gas cooling and hardening, that is, preheating, carburization and diffusion according to the processing patterns of FIG. 4, FIG. 5(*a*) and FIG. 6, and preheating and carbonitridation according to the processing pattern of FIG. 5(*b*), and preheating and carburization according to the processing pattern of FIG. 7 are performed in the vacuum heat treating furnace (1). Therefore, by means of the control device (18) of the control panel (16), the quantity of ethylene gas and that of hydrogen gas, the furnace pressure, the furnace temperature in the vacuum heat treating furnace (1) are controlled during these processes.

The present invention may be practiced in various other forms without departing from its subject matters. Therefore, the above embodiments are merely illustrative in all respects and are not interpreted in restrictive manner.

INDUSTRIAL APPLICABILITY

As described above, the vacuum heat treating process method and apparatus according to the present invention are useful for implementing vacuum heat treatments such as carburization, carbonitridation, high temperature carburization, high concentration carburization and the like, performed while supplying a mixed gas of ethylene gas and hydrogen gas, and are particularly suitable to obtain a heat treatment quality required for a workpiece with accuracy and reproducibility.

The invention claimed is:

1. A vacuum heat treating method which is performed while supplying a mixed gas of ethylene gas and hydrogen gas into a depressurized vacuum heat treating furnace, comprising:

storing plural settings of equivalent carbon concentration in the processing atmosphere that are determined in advance for obtaining required heat treatment quality, the plural settings of equivalent carbon concentration in correspondence with materials of the workpieces and used as a targeted value;

detecting a quantity of ethylene gas and that of hydrogen gas in the vacuum heat treating furnace;

calculating an equivalent carbon concentration of atmosphere on the basis of the detected quantity of ethylene gas and that of hydrogen gas; and comparing the calculated value with a targeted value which is set on the basis of a material specification and required heat treatment quality of an object to be treated inputted in advance, to control quantities of ethylene gas and hydrogen gas supplied into the vacuum heat treating furnace on the basis of a difference between the calculated value and the targeted value.

2. The vacuum heat treating method according to claim 1, comprising:

keeping constant the sum of the quantity of ethylene gas and that of hydrogen gas in the vacuum heat treating furnace.

3. The vacuum heat treating method according to claim 1 or 2, comprising:

keeping constant the pressure in the vacuum heat treating furnace.

4. A vacuum heat treating apparatus comprising:

a vacuum heat treating furnace;

evacuating means for depressurizing the interior of the vacuum heat treating furnace;

flow rate adjusting means for adjusting quantities of ethylene gas and hydrogen gas to be supplied into the vacuum heat treating furnace;

gas quantity detecting means for detecting a quantity of ethylene gas and that of hydrogen gas in the vacuum heat treating furnace; and a control panel to which the evacuating means, the flow rate adjusting means, and the gas quantity detecting means are connected, the control panel being provided with an input/output device and a control device, the control device of the control panel storing plural settings of equivalent carbon concentration in the processing atmosphere that are determined in advance for obtaining required heat treatment quality, the plural settings of equivalent carbon concentration in correspondence with materials of the workpieces and used as a targeted value, and the control device calculating the equivalent carbon concentration of atmosphere on the basis of the quantity of ethylene gas and that of hydrogen gas detected by the gas quantity detecting means, comparing this calculated value with the targeted value which is automatically set and stored on the basis of a material specification and required heat treatment quality of an object to be treated inputted into the input/output device, and controlling quantities of ethylene gas and hydrogen gas supplied into the vacuum heat treating furnace on the basis of a difference between the calculated value and the targeted value by means of flow rate adjusting means.

5. The vacuum heat treating apparatus according to claim 4, wherein the control device controls the flow rate adjusting means so that the sum of the quantity of ethylene gas and that of hydrogen gas in the vacuum heat treating furnace is constant.

6. The vacuum heat treating apparatus according to claim 4 or 5, further comprising:

pressure detecting means for detecting the pressure in the vacuum heat treating furnace, wherein the control device compares a detection value detected by the pressure detecting means with a preset targeted value, and controls the evacuating means so that the furnace pressure is constant.

7. The vacuum heat treating apparatus according to claim 4 or 5, wherein a plurality of processing patterns and soaking temperatures corresponding to the material specification of an object to be treated are set in the control device, and the processing pattern and the soaking temperature can be selected and inputted to the input/output device in correspondence with the material specification of the object to be treated.

8. The vacuum heat treating apparatus according to claim 4 or 5, wherein a plurality of heat treating temperatures corresponding to material specification, shape of an object to be treated and ventilation condition when one or more objects to be treated are loaded in a processing basket are set in the control device, and the heat treating temperature can be selected and inputted to the input/output device in correspondence with the material specification, shape and ventilation condition of the object to be treated.

9. The vacuum heat treating apparatus according to claim 4 or 5, wherein a plurality of preheating times corresponding to heat treating temperature are set in the control device, and the preheating time can be selected and inputted to the input/output device means in correspondence with the heat treating temperature.

10. The vacuum heat treating apparatus according to claim 9, wherein a dimension of a processing part of the object to be treated can be inputted to the control device, and when the inputted dimension of the processing part of the object to be treated exceeds a predetermined value, the control device corrects the preheating time on the basis of the excess value.

11. The vacuum heat treating apparatus according to claim 4 or 5, wherein the control device determines a carburization coefficient by effective case depth on the basis of the selected and inputted heat treating temperature.

12. The vacuum heat treating apparatus according to claim 11, wherein the control device calculates a total carburizing time required for carburization and diffusion on the basis of the carburization coefficient by the effective case depth, calculates a ratio between carburizing time and diffusing time on the basis of the required heat treatment quality, and determines a carburizing time and a diffusing time on the basis of these calculated values.

13. The vacuum heat treating apparatus according to claim 4 or 5, further comprising:

a feeding/discharging chamber for an object to be treated, which can be depressurized; and a transfer chamber which is provided adjoining the feeding/discharging chamber for one or more objects to be treated, and has transfer means being rotatable around the vertical axis, wherein a plurality of vacuum heat treating furnaces each having the evacuating means, the flow rate adjusting means, the gas quantity detecting means and the controlling means, and a hardening chamber and a soaking chamber which can be depressurized are provided with intervals in the circumferential direction around the transfer chamber.

14. The vacuum heat treating apparatus according to claim 13, wherein a gas cooling chamber which can be depressurized is provided around the transfer chamber with intervals from the vacuum heat treating furnace, the hardening chamber and the soaking chamber in the circumferential direction.

* * * * *